US012781516B2

(12) United States Patent
Perra

(10) Patent No.: US 12,781,516 B2
(45) Date of Patent: Nov. 3, 2026

(54) PANEL AND FLOOR COVERING COMPRISING THE SAME

(71) Applicant: I4F Licensing NV, Turnhout (BE)

(72) Inventor: Antonio Giuseppe Perra, Bergen (NL)

(73) Assignee: i4F Licensing NV, Turnhout (BE)

( * ) Notice: Subject to any disclaimer, the term of this patent is extended or adjusted under 35 U.S.C. 154(b) by 50 days.

(21) Appl. No.: 18/782,766

(22) Filed: Jul. 24, 2024

(65) Prior Publication Data

US 2024/0376723 A1 Nov. 14, 2024

Related U.S. Application Data

(63) Continuation of application No. 17/427,001, filed as application No. PCT/NL2019/050055 on Jan. 30, 2019, now Pat. No. 12,065,838.

(51) Int. Cl.

*E04F 15/02* (2006.01)
*E04F 15/10* (2006.01)
*E04F 13/08* (2006.01)

(52) U.S. Cl.

CPC ..... *E04F 15/02038* (2013.01); *E04F 15/102* (2013.01); *E04F 15/105* (2013.01); *E04F 15/107* (2013.01); *E04F 13/0894* (2013.01); *E04F 2201/0146* (2013.01); *E04F 2201/0161* (2013.01); *E04F 2201/023* (2013.01); *E04F 2201/027* (2013.01); *E04F 2201/042* (2013.01); *E04F 2201/043* (2013.01)

(58) Field of Classification Search

CPC ..... E04F 15/02038; E04F 13/0894; E04F 2201/0146; E04F 2201/0161; E04F 2201/023; E04F 2201/027; E04F 2201/042; E04F 2201/043; E04F 15/102; E04F 15/105; E04F 15/107; E04F 2201/04; E04F 2201/03

See application file for complete search history.

(56) References Cited

U.S. PATENT DOCUMENTS

| | | | | |
|---|---|---|---|---|
| 6,209,278 | B1 | 4/2001 | Tychsen | |
| 8,191,333 | B2 | 6/2012 | Braun | |
| 8,544,231 | B2 | 10/2013 | Hannig | |
| 8,833,028 | B2 | 9/2014 | Whispell et al. | |
| RE47,496 | E * | 7/2019 | Hannig | C10L 11/06 |

(Continued)

FOREIGN PATENT DOCUMENTS

| | | |
|---|---|---|
| CA | 2940587 A1 | 9/2015 |
| DE | 10120062 B4 | 3/2008 |

(Continued)

*Primary Examiner* — Brent W Herring
(74) *Attorney, Agent, or Firm* — The Webb Law Firm

(57) ABSTRACT

A panel and to a floor covering including the same. The present disclosure also relates to other coverings, such as a wall covering, which are constructed by using a plurality of the panels. According to the disclosure, the panel includes a first and second coupling profile on opposing sides of the panel. The first coupling profile includes an upward tongue that has a curved portion. This upward tongue is spaced apart from a first inner flank of the panel by a clearance that defines an upward groove. According to the invention, an outermost point of the curved portion is positioned further away from the first inner flank than a center point of the upward tongue.

22 Claims, 10 Drawing Sheets

(56) References Cited

U.S. PATENT DOCUMENTS

| | | | | |
|---|---|---|---|---|
| 10,724,251 | B2 * | 7/2020 | Kell | E04G 23/0285 |
| 10,738,477 | B2 | 8/2020 | Hannig | |
| 10,947,741 | B2 * | 3/2021 | Boucké | E04F 15/10 |
| 11,319,712 | B2 | 5/2022 | Hannig | |
| 2004/0123547 | A1 * | 7/2004 | Grafenauer | E04F 15/02 52/592.1 |
| 2011/0167744 | A1 | 7/2011 | Whispell et al. | |
| 2011/0296780 | A1 | 12/2011 | Windmoller | |
| 2014/0033633 | A1 | 2/2014 | Kell | |
| 2015/0218812 | A1 | 8/2015 | Kell | |
| 2017/0241136 | A1 | 8/2017 | Kell | |
| 2018/0179763 | A1 | 6/2018 | Simon et al. | |
| 2020/0318360 | A1 * | 10/2020 | De Rick | E04F 15/02038 |
| 2021/0381254 | A1 | 12/2021 | Boucke | |
| 2022/0120093 | A1 | 4/2022 | Perra | |
| 2022/0396953 | A1 | 12/2022 | Settels | |

FOREIGN PATENT DOCUMENTS

| | | | |
|---|---|---|---|
| DE | 102016000015 | A1 | 7/2017 |
| EP | 1380710 | A2 | 1/2004 |
| EP | 3031998 | A1 | 6/2016 |
| JP | 2000145104 | A | 5/2000 |
| JP | 2010514964 | A | 5/2010 |
| JP | 2018507968 | A | 3/2018 |
| WO | 2012126046 | A1 | 9/2012 |
| WO | 2016029255 | A1 | 3/2016 |

* cited by examiner

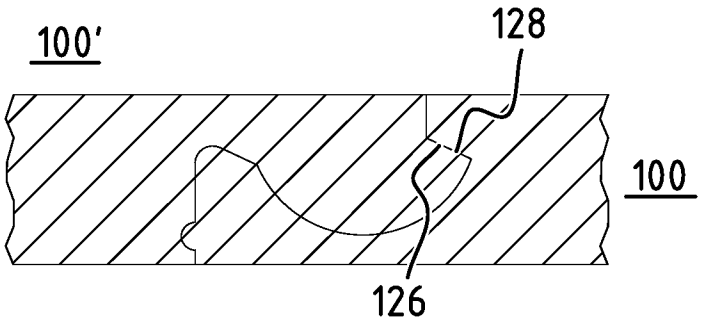
FIG. 4E
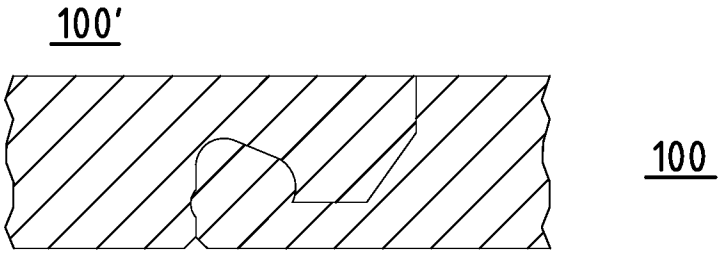
FIG. 4F
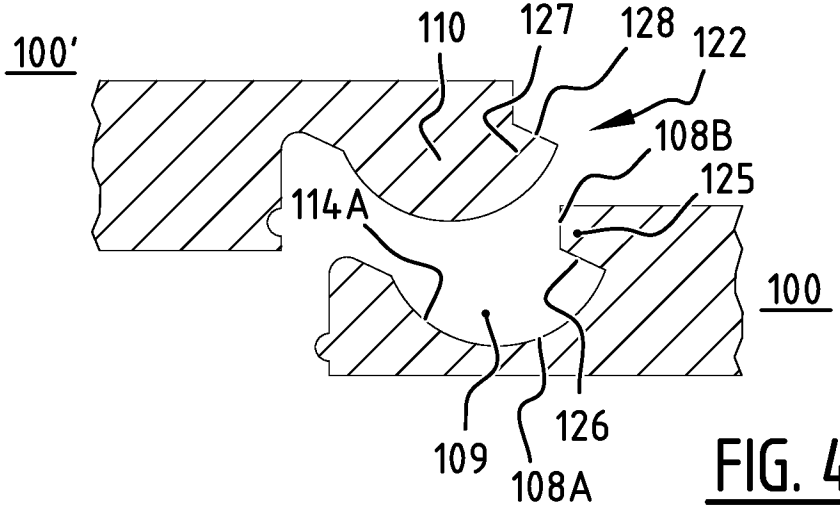
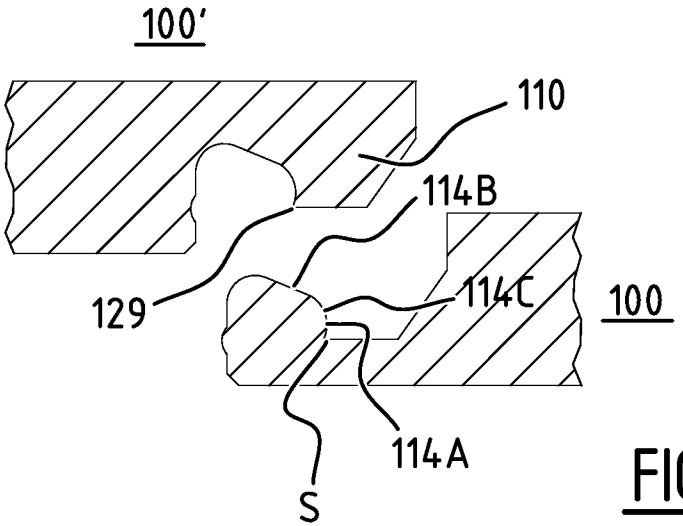

PANEL AND FLOOR COVERING COMPRISING THE SAME

CROSS-REFERENCE TO RELATED APPLICATIONS

This application is a continuation of U.S. patent application Ser. No. 17/427,001, filed Jul. 29, 2021, which is the United States national phase of International Application No. PCT/NL2019/050055 filed Jan. 30, 2019, the disclosures of which are hereby incorporated by reference in their entireties.

BACKGROUND OF THE INVENTION

Field of the Invention

The present invention relates to a panel and to a floor covering comprising the same. The present invention also relates to other coverings, such as a wall covering, which are constructed by using a plurality of the panels.

Description of Related Art

Floor coverings that comprise a plurality of coupled panels are known in the art. An example of a panel as disclosed in EP3031998B1. The coupling profiles of this panel are illustrated in FIG. 1.

Known panel 1 comprises a core 2 having a first side that is provided with a first extension region 3 and a second side that is provided with a second extension region 4. Here, it is noted that the first side is oppositely arranged relative to the second side. FIG. 1 therefore depicts the first side of a first panel 1 and the second side of an adjacently arranged identical second panel 1' that is to be coupled to first panel 1.

First extension region 3 comprises a first coupling profile 5 and second extension region 4 comprises a second coupling profile 6 that is complementary to first coupling profile 5. Panels 1, 1' can be coupled to each other using complementary coupling profiles 5, 6.

Typically, panels of the type as shown in FIG. 1 comprise coupling profiles on all sides of the panel. As the panels typically have a rectangular shape a distinction can be made between the long side of the panel and the short side of the panel.

Furthermore, different types of panels are known in the art. These types can be distinguished based on the manner in which they are coupled. For example, a drop-and-lock type of panel is known in which panels can be coupled by a substantially vertical movement of a new panel and a panel that is already arranged on the floor. Another type is referred to as angle-to-angle panels, wherein a row of panels is kept in a coupled state at an angle relative to the floor before tilting them downward to achieve final coupling with a row of panels that is already arranged on the floor.

Now returning to FIG. 1, first coupling profile 5 comprises an upward tongue 7 that runs at a distance from and parallel to a first inner flank 8 of core 2. A clearance between first inner flank 8 of core 2 and upward tongue 7 forms an upward groove 9. Second coupling profile 6 comprises a downward tongue 10 that runs at a distance from and parallel to a second inner flank 11 of core 2. A clearance between second inner flank 11 of core 2 and downward tongue 10 forms a downward groove 12.

Upward tongue comprises a curved portion 13, an upward flank 14 extending from a bottom 15 of upward groove 9 to curved portion 13, and a downward flank 16 extending from curved portion 13 and forming an outer edge of panel 1. Here, it is noted that in FIG. 1, downward flank 16 comprises a first part 16A and a second part 16B, wherein second part 16B is provided with a first coupling element 17 in the shape of a bulge.

A width of upward tongue 7 can be defined as the distance between a starting point S of upward flank 14 and an outer point O on downward flank 16. Here, the outer point can be defined as the most outer point of panel 1 on the first side.

In the known panel, second inner flank 11 is provided with a second coupling element 18 in the shape of a recess. First coupling element 17 is configured to co-act with second coupling element 18 of an adjacently arranged further panel, such as panel 1', for the purpose of mutually locking panel 1 and panel 1'.

A known problem with any floor panel of the abovementioned type is related to the expansion and contraction of the panels due to changing environmental conditions such as heat and moisture. As a result of these changing conditions, the floor covering may start to display gaps between adjacent floor panels, especially at their short sides. These gaps are generally caused by a disengagement of the locking provided by the first and second coupling elements.

SUMMARY OF THE INVENTION

An object of the present invention is to provide a panel that is less susceptible to a disengagement of the locking of the first and second coupling elements.

This object is achieved with the panel disclosed herein that is characterized in that an outermost point of the curved portion is positioned further away from the first inner flank than a center point of the upward tongue.

Typically, the panel has an essentially flat shape with a bottom side and a top side. The bottom side represents the side of the panel that is to be placed on the subfloor or other supporting surface on which the panel is to be placed. On the top side, a decorative layer may be present.

Within the context of the present invention, wording such as downward tongue or upward tongue should not be construed as being limited to a tongue that extends up or down relative to the subfloor, respectively. Instead, the wording downward and upward is merely used to distinguish between tongues that extend in opposite directions. Although the invention is particularly related to panels wherein the first extension region extends from the bottom side and the second extension region from the top side, the invention also covers the inverse configuration. Hereinafter, configurations will be discussed wherein the first extension region extends from the bottom side. The other configurations, although not mentioned explicitly, can be easily derived therefrom.

The curved portion of the upward tongue is generally a convex curved portion. The outermost point is then the most protruding point of the curved portion and of the upward tongue when viewed along a normal of the panel.

Compared to the known panel shown in FIG. 1, the panel of the present invention is characterized in that the outermost point is located more to the edge of the panel than that of the known panel. The effect of this arrangement is that, compared to the known panel, the coupling between the first and second coupling elements of adjacent panels is less likely to be broken under the influence of heat and/or moisture.

A width of the upward tongue can be defined as corresponding to a distance in a direction parallel to the panel between a starting point of the upward flank and the outer point on the downward flank. The center point of the upward tongue is then positioned at half the width relative to the starting point.

As an example, a distance between the starting point and the outermost point of the curved portion in a direction parallel to the panel may equal x times the width of the upward tongue, wherein x is equal to or larger than 0.5.

When the first extension region extends from the bottom side of the panel, the outermost point of the curved portion may correspond to the top of the curved portion. Alternatively, when the first extension region extends from the top side of the panel, the outermost point of the curved portion may correspond to the bottom of the curved portion.

The upward flank may comprise a first flank portion extending from the starting point, and a second flank portion extending between the first flank portion and the curved portion. An inclination of the first flank portion may be different from an inclination of the second flank portion at least at a connection point where the first and second flank portions are connected. As an example, a distance between the starting point and the connection point may be y times the width of the upward tongue, wherein y lies in a range between 0 and 0.3.

The first and/or second flank portions can be essentially flat. However, these flank portions may each be provided, separately and individually, with one or more coupling elements for coupling with adjacent panels. In such case, flank portion(s) of the downward tongue may be provided with complementary coupling elements for co-acting with the aforementioned one or more coupling elements. These coupling elements may be shaped as complementarily shaped recesses and protrusions.

An angle of the first flank portion relative to a normal of the panel may be smaller than an angle of the second flank portion relative to the normal of the panel. Put differently, the first flank portion may be steeper than the second flank portion.

The first flank portion may also be curved. For example, the first inner flank may comprise a curved portion that is connected to the first flank portion. The panel may then further comprise an outwardly extending lip to which the curved portion of the first inner flank extends, wherein the lip defines a first locking surface that is directed towards the upward groove. The downward tongue comprises an upward flank forming a further outer edge of the panel. This upward flank may comprise a protruding edge that defines a second locking surface. The first locking surface and the second locking surface may be configured to lock an upward movement of an adjacent panel when the second coupling profile of this adjacent panel is coupled to the first coupling profile of the panel and the first and second locking surfaces abut each other.

The second flank portion may comprise a bulge that extends inwardly beyond the starting point. The bulge defines, together with the first flank portion, a space in which a protruding element arranged on an inner side of the downward tongue of the second coupling profile of an adjacent panel can be received for achieving a further locking.

In some embodiments, x may lie in the range between 0.5 and 1, and more preferably between 0.65 and 0.85. In this case, the downward flank may extend substantially parallel to a normal of the panel. Alternatively, the downward flank may extend in an inwardly inclined manner relative to the normal. Here, a connection point of the downward flank with the curved portion may be arranged more outwardly than a point where the downward flank contacts the surface on which the panel is or will be arranged. As an example, an inclination of the downward flank may lie in a range between 0 and 30 degrees relative to the normal of the panel.

In other embodiments, x may lie in the range between 0.5 and 0.7. In these embodiments, the downward flank may extend in an outwardly inclined manner relative to the normal of the panel. Here, a point where the downward flank contacts the surface on which the panel is or will be arranged may be arranged more outwardly than a connection point of the downward flank with the curved portion. The inclination of the downward flank may lie in a range between 0 and 30 degrees relative to the normal of the panel.

The downward flank may, apart from the first locking element, be essentially flat.

The first and second locking elements may be complementary structures. For example, the first locking element may be a protruding element, such as a bulge, and the second locking element may be a recess for receiving the protruding element, or vice versa.

The first locking element may comprise a recess extending inwardly relative to the downward flank, wherein the recess has a bottom and side walls extending from the bottom to an outside of the downward flank. The first locking element may further comprise a protruding portion that extends from the bottom toward the outside of the downward flank.

The second locking element may comprise a protruding portion that comprises side walls that extend outwardly from an outside of the second inner flank to a base portion, and a recess extending from the base portion inwardly relative to the second inner flank.

The protruding portion of the second locking element is divided, by the recess of the second locking element, into two oppositely arranged protruding sub-portions and the recess of the first locking element is divided, by the protruding portion of the first locking element, into two oppositely arranged sub-recesses.

Especially when combined with the positioning of the outermost point of the curved portion, this combination of the first and second locking elements provides a particular efficient locking when compared to the aforementioned combination of bulge and recess. More in particular, a triple locking function is obtained being: 1) the locking function between the protruding portion of the first locking element and the recess of the second locking element, 2) the locking function between a first protruding sub-portion of the second locking element and a corresponding first sub-recess of the first locking element, and 3) the locking function between a second protruding sub-portion of the second locking element and a corresponding second sub-recess of the first locking element.

In a preferred embodiment, the protruding portion of the first locking element is fully arranged in the recess of the first locking element and the recess of the second locking element is fully arranged in the protruding portion of the second locking element. More preferably, the protruding portion of the first locking element may extend in a range between 20 and 90 percent, and more preferably between 50 and 90 percent, of the depth of the recess of the first locking element and the recess of the second locking element may extend in a range between 20 and 90 percent, and more preferably between 50 and 90 percent, of the length of the protruding portion of the second locking element.

The abovementioned combination of first and second locking elements may be reversed. In such case, the second locking element may comprise a recess extending inwardly relative to the second inner flank. This recess has a bottom and side walls extending from the bottom to an outside of the second inner flank. The second locking element may then further comprise a protruding portion extending from the bottom toward the outside of the second inner flank. In this case, the first locking element may comprise a protruding portion comprising side walls that extend outwardly from an outside of the downward flank to a base portion, and a recess extending from the base portion inwardly relative to the downward flank.

The protruding portion of the first locking element is divided, by the recess of the first locking element, into two oppositely arranged protruding sub-portions and the recess of the second locking element is divided, by the protruding portion of the second locking element, into two oppositely arranged sub-recesses.

The protruding portion of the second locking element can be configured to be received in the recess of the first locking element and each protruding sub-portion of the first locking element can be configured to be received in a respective sub-recess of the second locking element.

The protruding portion of the second locking element can be fully arranged in the recess of the second locking element and the recess of the first locking element can be fully arranged in the protruding portion of the first locking element. More preferably, the protruding portion of the second locking element may extend in a range between 20 and 90 percent, and more preferably between 50 and 90 percent, of the depth of the recess of the second locking element and the recess of the first locking element may extend in a range between 20 and 90 percent, and more preferably between 50 and 90 percent, of the length of the protruding portion of the first locking element.

The downward flank of the upward tongue may comprise a protruding portion in which the first locking element is arranged and the second inner flank may comprise a protruding portion in which the second locking element is arranged. For example, the downward flank may comprise a protruding portion in an otherwise essentially flat flank. Combining the protruding portion in the downward flank with the first locking element described above, more in particular the first locking element having the recess in which a protruding portion is arranged, would result in the recess extending inwardly from an outer end of the protruding portion of the downward flank.

The downward tongue may comprise a connection portion, a downward flank extending from a bottom of the downward groove to the connection portion, and an upward flank extending from the connection portion and forming a further edge of the panel.

The first inner flank may comprise a third locking element and the upward flank of the downward tongue may comprise a fourth locking element that is configured to co-act with the third coupling element. The third locking element and the fourth locking element can be configured in a similar manner as the first and second locking element. Using the third and fourth locking elements, an additional locking can be achieved between adjacent panels.

In a first configuration of the third and fourth locking elements, the third locking element may comprise a recess extending inwardly relative to the first inner flank, wherein the recess has a bottom and side walls extending from the bottom to an outside of the first inner flank. The third locking element may further comprise a protruding portion extending from the bottom toward the outside of the first inner flank.

The fourth locking element may comprise a protruding portion comprising side walls that extend outwardly from an outside of the upward flank of the downward tongue to a base portion, and a recess extending from the base portion inwardly relative to the upward flank of the downward tongue. The protruding portion of the fourth locking element may be divided, by the recess of the fourth locking element, into two oppositely arranged protruding sub-portions. The recess of the third locking element may be divided, by the protruding portion of the third locking element, into two oppositely arranged sub-recesses.

The protruding portion of the third locking element may be configured to be received in the recess of the fourth locking element and each protruding sub-portion of the fourth locking element can be configured to be received in a respective sub-recess of the third locking element. In this manner, a triple lock function can be achieved as described above.

The protruding portion of the third locking element is preferably fully received in the recess of the third locking element. Similarly, the recess of the fourth locking element is preferably fully received in the protruding portion of the fourth locking element. More preferably, the protruding portion of the third locking element may extend in a range between 20 and 90 percent, and more preferably between 50 and 90 percent, of the depth of the recess of the third locking element and the recess of the fourth locking element extends in a range between 20 and 90 percent, and more preferably between 50 and 90 percent, of the length of the protruding portion of the fourth locking element.

In a second configuration of the third and fourth locking elements, the fourth locking element may comprise a recess extending inwardly relative to the upward flank of the downward tongue, wherein the recess has a bottom and side walls extending from the bottom to an outside of the upward flank of the downward tongue. The fourth locking element may then further comprise a protruding portion extending from the bottom toward the outside of the upward flank of the downward tongue.

The third locking element may comprise a protruding portion comprising side walls that extend outwardly from an outside of the first inner flank to a base portion, and a recess extending from the base portion inwardly relative to the first inner flank.

The protruding portion of the third locking element may be divided, by the recess of the third locking element, into two oppositely arranged protruding sub-portions. The recess of the fourth locking element may be divided, by the protruding portion of the fourth locking element, into two oppositely arranged sub-recesses.

The protruding portion of the fourth locking element can be configured to be received in the recess of the third locking element, and each protruding sub-portion of the third locking element can be configured to be received in a respective sub-recess of the fourth locking element. In this manner, a triple lock function can be achieved as described above.

The protruding portion of the fourth locking element is preferably fully received in the recess of the fourth locking element. Similarly, the recess of the third locking element is preferably fully received in the protruding portion of the third locking element. More preferably, the protruding portion of the fourth locking element may extend in a range between 20 and 90 percent, more preferably between 50 and 90 percent, of the depth of the recess of the fourth locking element and the recess of the third locking element may extend in a range between 20 and 90 percent, and more preferably between 50 and 90 percent, of the length of the protruding portion of the third locking element.

The first inner flank may comprise a protruding portion in or on which the third locking element is arranged and the upward flank of the downward tongue may comprise a protruding portion in or on which the fourth locking element is arranged.

The curved portion of the upward tongue may bulge outwardly beyond at least a portion of the downward flank. This bulge may form, together with a complementary shaped downward groove, a further locking between adjacent panels.

The panel may be a laminated floor panel of which the core is made from at least one of medium-density fiberboard (MDF) or a high-density fiberboard (HDF). However, the present invention does not exclude other materials and is equally related to hardwood panels, solid wood panels, or PVC based panels. Moreover, the panel may equally be used for coverings of other substrates, such as walls or ceilings.

The panel may further comprise a step in a direction parallel to a normal of the panel between the upward flank and the curved portion. Such step may, when combined with a complementarily shaped downward groove, provide a further locking in a direction parallel to a top surface of the panel.

According to a second aspect, the present invention provides a floor covering comprising a plurality of panels as defined above, wherein the first coupling profile of a given panel among the plurality of panels is coupled to the second coupling profile of another panel among the plurality of panels that is arranged adjacent to said given panel.

BRIEF DESCRIPTION OF THE DRAWINGS

Next, the invention will be described in more detail referring to the appended drawings wherein:

FIGS. 4A-4L illustrate various different embodiments of the first and second coupling profiles in accordance with the present invention.

DESCRIPTION OF THE INVENTION

Figure 2A:
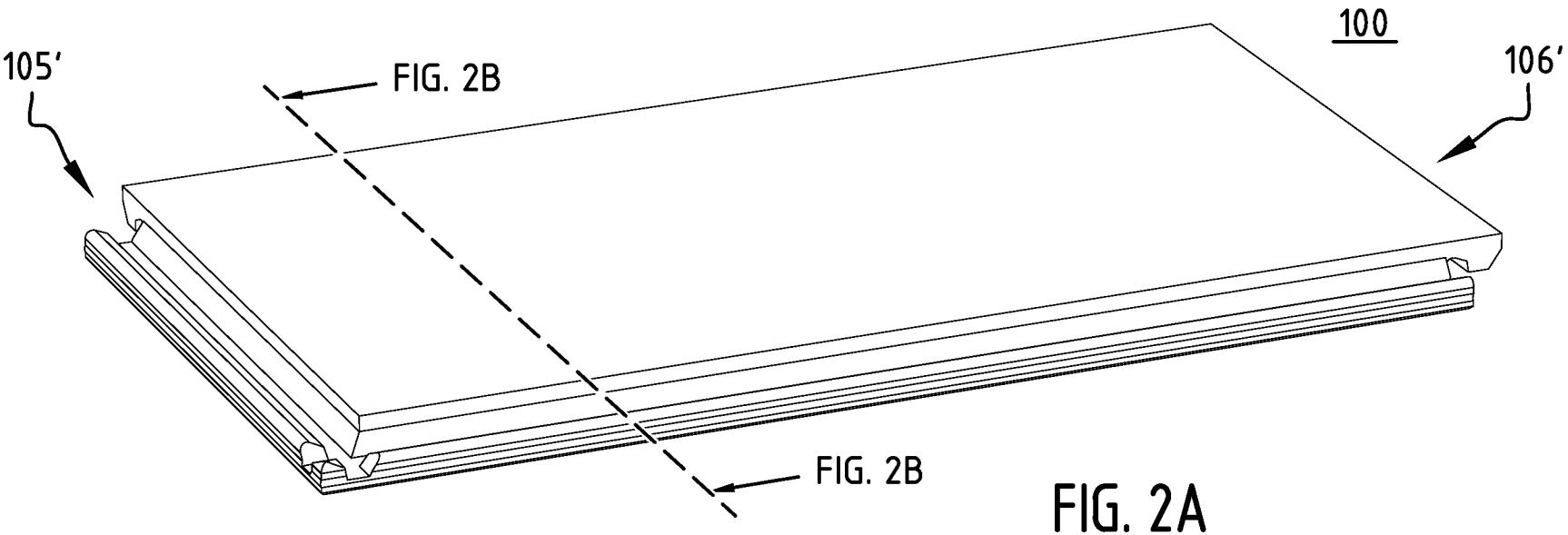
FIGS. 2A-2B illustrate a perspective view of a floor panel in accordance with the present invention as well as a corresponding cross section illustrating the coupling profiles on the long side, respectively.
Figure 2B:
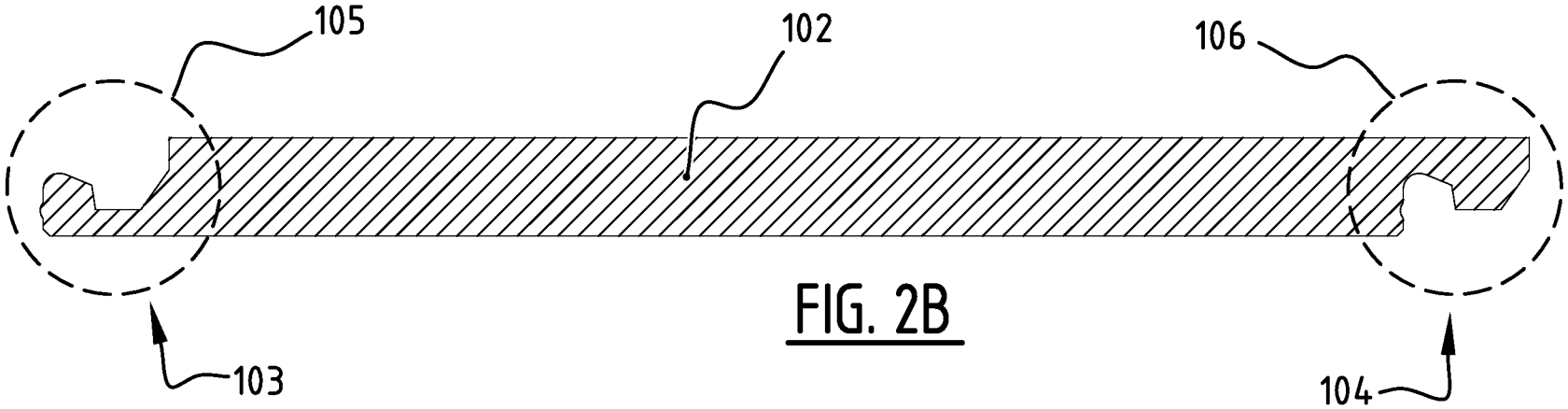

FIG. 2 illustrates a perspective view of a floor panel 100 in accordance with the present invention as well as a corresponding cross section.

Figure 1:
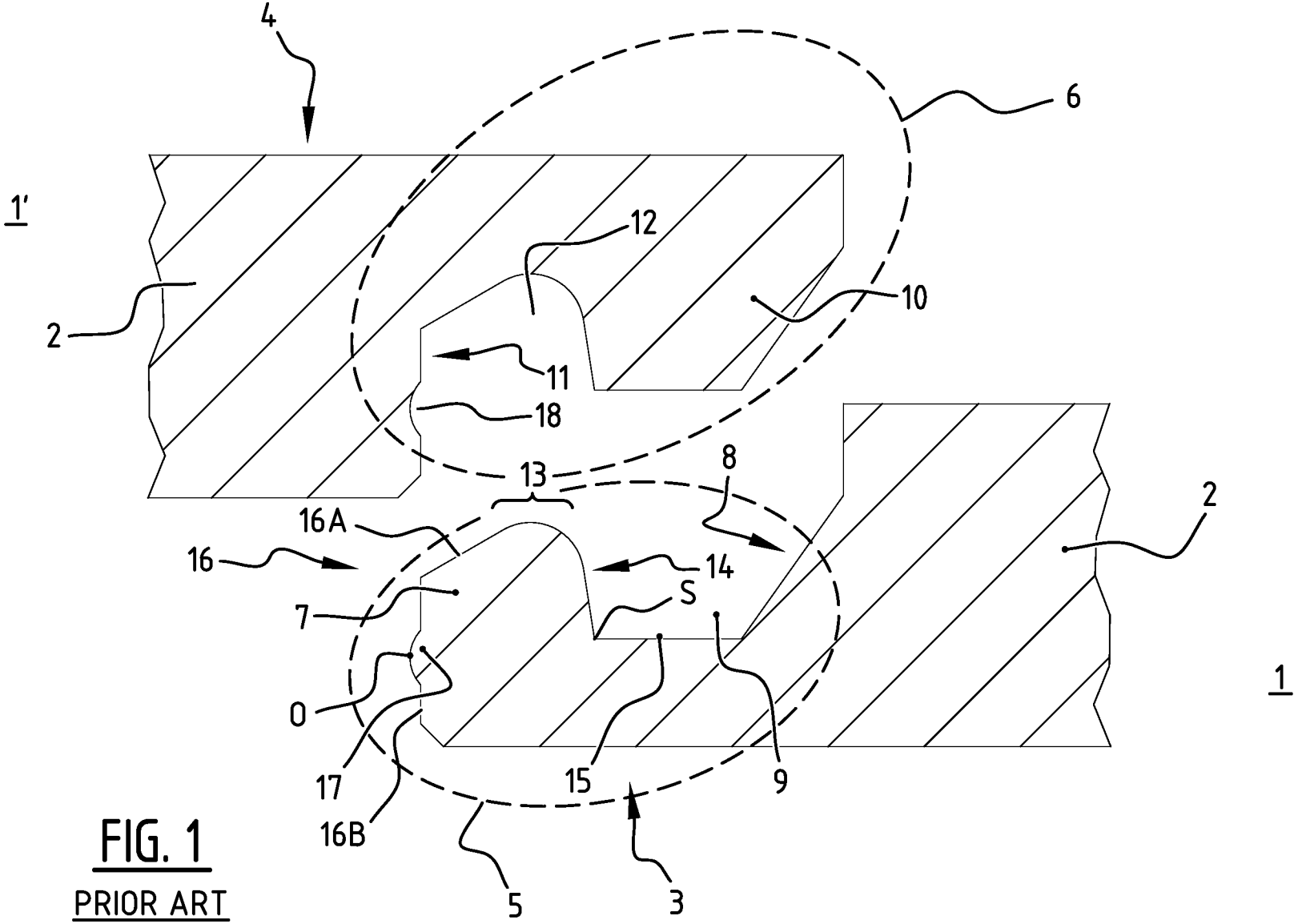
FIG. 1 PRIOR ART
FIG. 1 illustrates first and second coupling profiles for a known floor panel.

Similar to the known panel in FIG. 1, panel 100 of the invention comprises a core 102 having a first side that is provided with a first extension region 103 and a second side that is provided with a second extension region 104.

As shown, the first side is oppositely arranged relative to the second side. Moreover, first extension region 103 comprises a first coupling profile 105 and second extension region 104 comprises a second coupling profile 106 that is complementary to first coupling profile 105. Identical panels 100 can be coupled to each other by coupling a first coupling profile 105 of one panel 100 to a second coupling profile 106 of an adjacent panel 100.

Panel 100 shown in FIG. 2 comprises coupling profiles on all sides of panel 100. For example, the coupling profile on the short side, indicated by arrow 105' can be configured in a similar way as first coupling profile 105. Similarly, the coupling profile on the opposite short side, indicated by arrow 106', can be configured in a similar way as second coupling profile 106.

Figure 3:
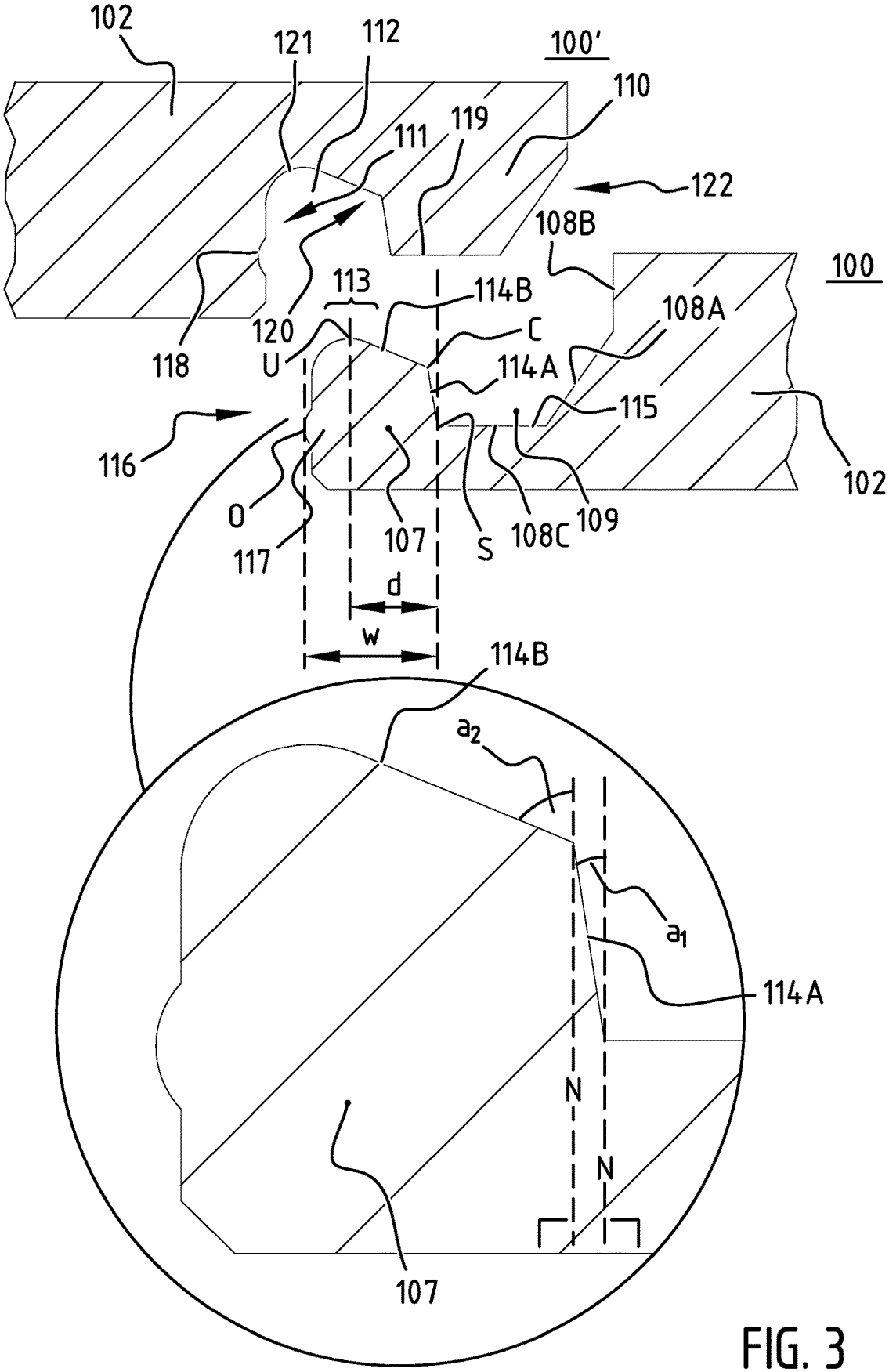
FIG. 3 illustrates a detailed view of the first and second coupling profiles of the floor panel of FIG. 2.

Now referring to the detailed view of FIG. 3, first coupling profile 105 comprises an upward tongue 107 that runs at a distance from and parallel to a first inner flank 108 of core 102. A clearance between first inner flank 108 of core 102 and upward tongue 107 forms an upward groove 109. Second coupling profile 106, shown here as part of an adjacent panel 100' but equally applying to panel 100 albeit at the opposite side relative to first coupling profile 105, comprises a downward tongue 110 that runs at a distance from and parallel to a second inner flank 111 of core 102. A clearance between second inner flank 111 of core 102 and downward tongue 110 forms a downward groove 112.

Upward tongue 107 comprises a curved portion 113, an upward flank 114 extending from a bottom 115 of upward groove 109 up to curved portion 113, and a downward flank 116 extending from curved portion 113 and forming an outer edge of panel 100. Downward flank 116 comprises a first coupling element 117 in the shape of a bulge.

A width w of upward tongue 117 can be defined as the distance between a starting point S of upward flank 14 and an outer point O on downward flank 116. Here, the outer point can be defined as the most outer point of panel 100 on the first side.

Second inner flank 111 is provided with a second coupling element 118 in the shape of a recess. First coupling element 117 of a given panel is configured to co-act with second coupling element 118 of an adjacent panel for the purpose of mutually locking panels 100, 100'.

As shown in FIG. 3, outermost point U of upward tongue 107 is located at a distance d away from starting point S. According to the invention, the ratio between d and w, denoted by x and equaling d/w, is equal to or larger than 0.5. The combination of the configuration of upward tongue 107 and the provision of the first and second locking elements reduces the likelihood of detachment of the first and second locking elements of adjacently arranged and coupled panels under the influence of heat and moisture.

Further, downward groove 112 is shaped substantially complementarily to upward tongue 107 so that upward tongue 107 can be received in downward groove 112. Similarly, downward tongue 110 is shaped substantially complementarily to upward groove 109 so that downward tongue 110 can be received in upward groove 109.

Upward flank 114 comprises a first flank portion 114A extending from starting point S, and a second flank portion 114B extending between first flank portion 114A and curved portion 113. Flank portions 114A, 114B, which are essentially flat in the embodiment in FIG. 3, are connected at connection point C. Moreover, a distance between starting point S and connection point C is roughly 0.15 times width d of upward tongue 107.

An angle a1 of first flank portion 114A relative to a normal N of panel 100, is smaller than an angle a2 of second flank portion 114B relative to the normal of panel 100.

Downward flank 116 extends substantially parallel to normal N of panel 100, and apart from first locking element 117, is essentially flat.

Downward tongue 110 comprises a connection portion 119, a downward flank 120 extending from a bottom 121 of downward groove 112 to connection portion 119, and an upward flank 122 that extends from connection portion 119 and forms a further edge of panel 100, and of panel 100'.

In FIG. 3, first inner flank 108 comprises a first inner flank portion 108A and a second inner flank portion 108B, which portions 108A, 108B are essentially flat. Moreover, a flat region 108C is present between first inner flank portion 108A and first flank portion 114A which forms the bottom of upward groove 109.

FIGS. 4A-4L illustrate various different embodiments of the first and second coupling profiles in accordance with the present invention. In each of the FIGS. 4A-4L, the first and second coupling profiles are shown in a detached state (on the left) and in a coupled state (on the right). Furthermore, the embodiment shown in FIG. 4A corresponds to the embodiment shown in FIG. 3.

Figure 4A:
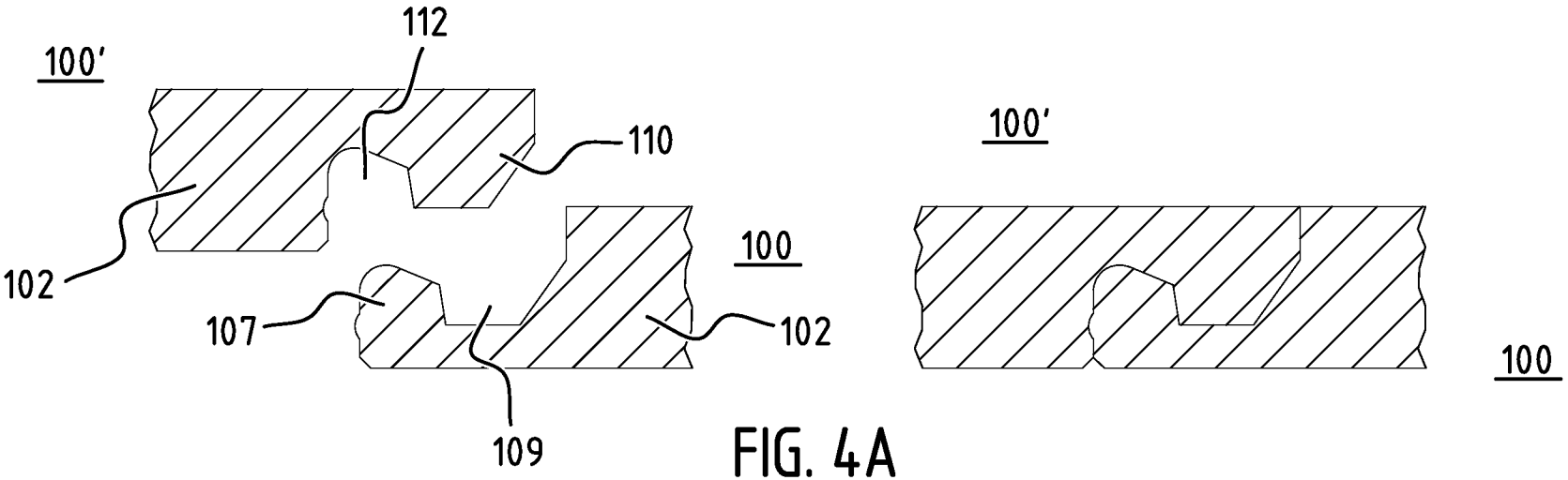
Figure 4B:
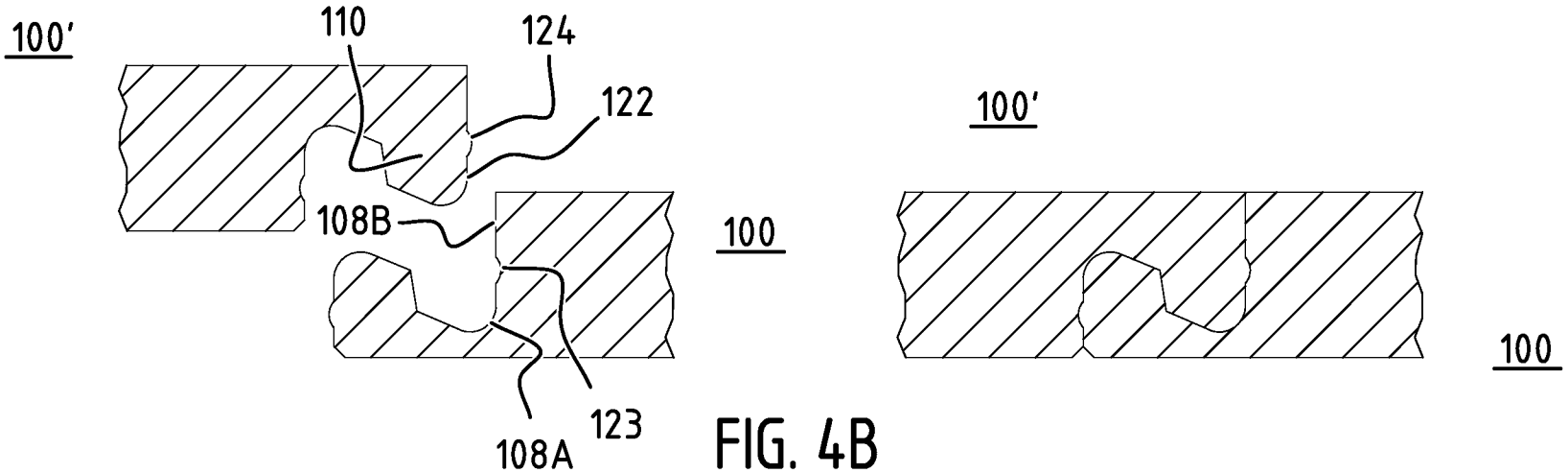

In the embodiment of FIG. 4B, first inner flank portion 108A is directly connected to first flank portion 108B. Moreover, first inner flank portion 108A is curved. In addition, a third locking element 123 is provided on first inner flank 108. A complementarily shaped fourth locking element 124 is provided on upward flank 122 of downward tongue 110. As shown in the coupled configuration, third and fourth locking elements 123, 124 provide for a further coupling between adjacent panels 100, 100'.

Figure 4C:
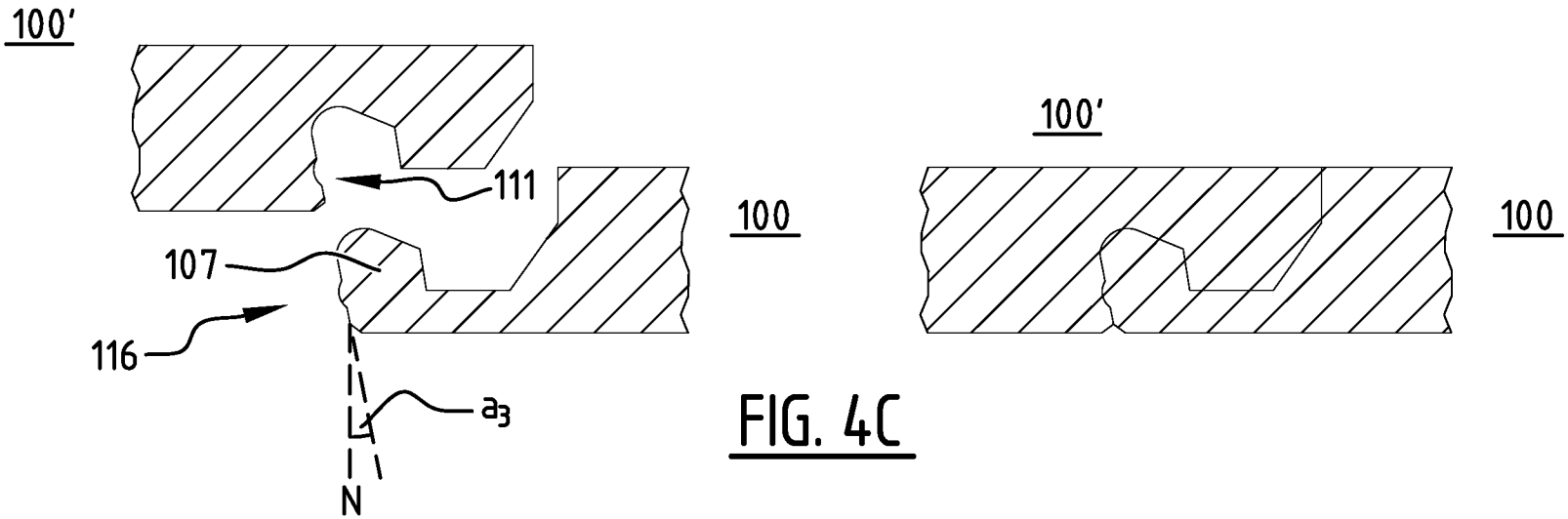

The embodiment shown in FIG. 4C is similar to the embodiment of FIG. 4A with the exception of downward flank 116, which in FIG. 4A, is inclined inwardly. More in particular, downward flank 116 is at an angle a3 of approximately 15 degrees relative to normal N of panel 100. By having second inner flank 111 complementarily shaped relative to downward flank 116 a further locking is provided between adjacent panels due to the fact that second inner flank 111 will snap at least partially under upward tongue 107.

Figure 4D:
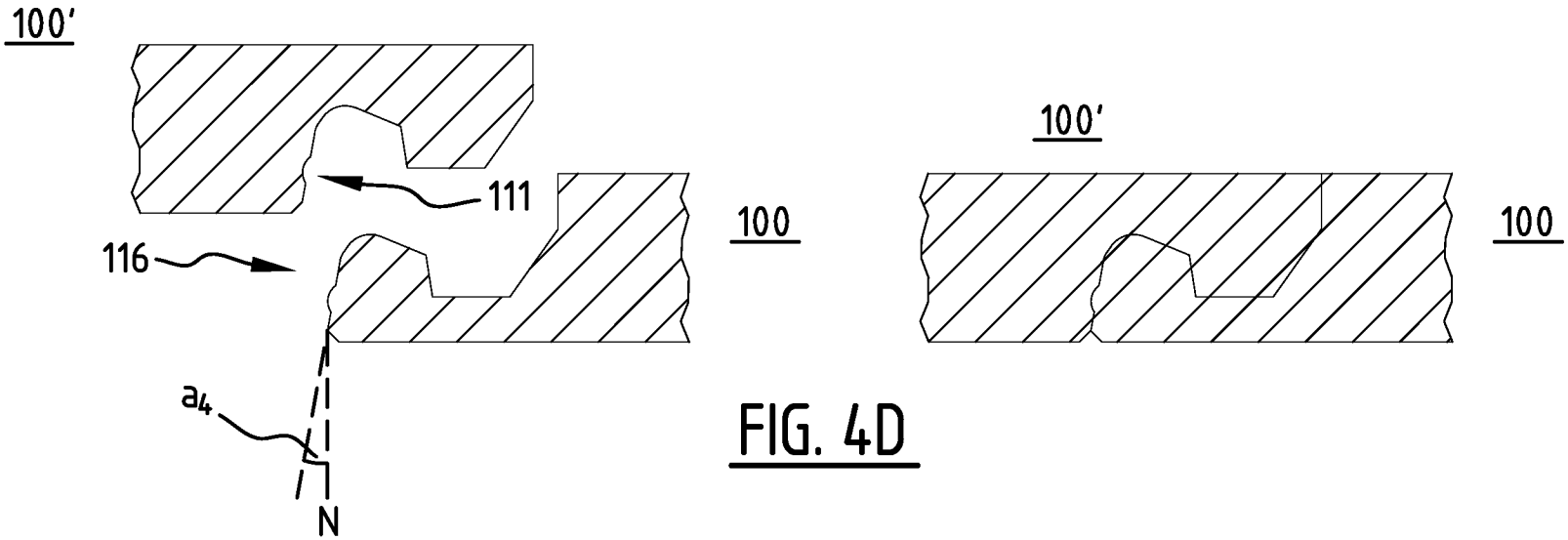

However, the present invention does not exclude other embodiments such as the one shown in FIG. 4D. In this embodiment, downward flank 116 is inclined outwardly. More in particular, downward flank 116 is at an angle a4 of approximately 15 degrees relative to normal N of panel 100. Similar to the embodiment shown in FIG. 4C, second inner flank 111 is shaped in a complementary shape to downward flank 116.

In the embodiment shown in FIG. 4E, both first flank portion 114A and first inner flank portion 108A are curved. An outwardly extending lip 125 is provided to which first inner flank portion 108A extends. Lip 125 defines a first locking surface 126 that is directed towards upward groove 109. Downward tongue 110 comprises an upward flank 122 forming a further outer edge of panel 100. In this embodiment, upward flank 122 of downward tongue 110 comprises a protruding edge 127 that defines a second locking surface 128. As shown in the coupled state on the right, locking surfaces 126, 128 abut each other and lock an upward movement of panel 100' relative to panel 100.

In the embodiment shown in FIG. 4F, second flank portion 114B comprises a bulge 114C that extends inwardly beyond starting point S. More in particular, first flank portion 114A is very small in this embodiment and can even be considered part of bulge 114C.

By having bulge 114C extending beyond starting point S, a cavity is formed that can be engaged by edge 129 of downward tongue 110 thereby providing a further locking of an upward movement of panel 100' relative to panel 100.

Figure 4G:
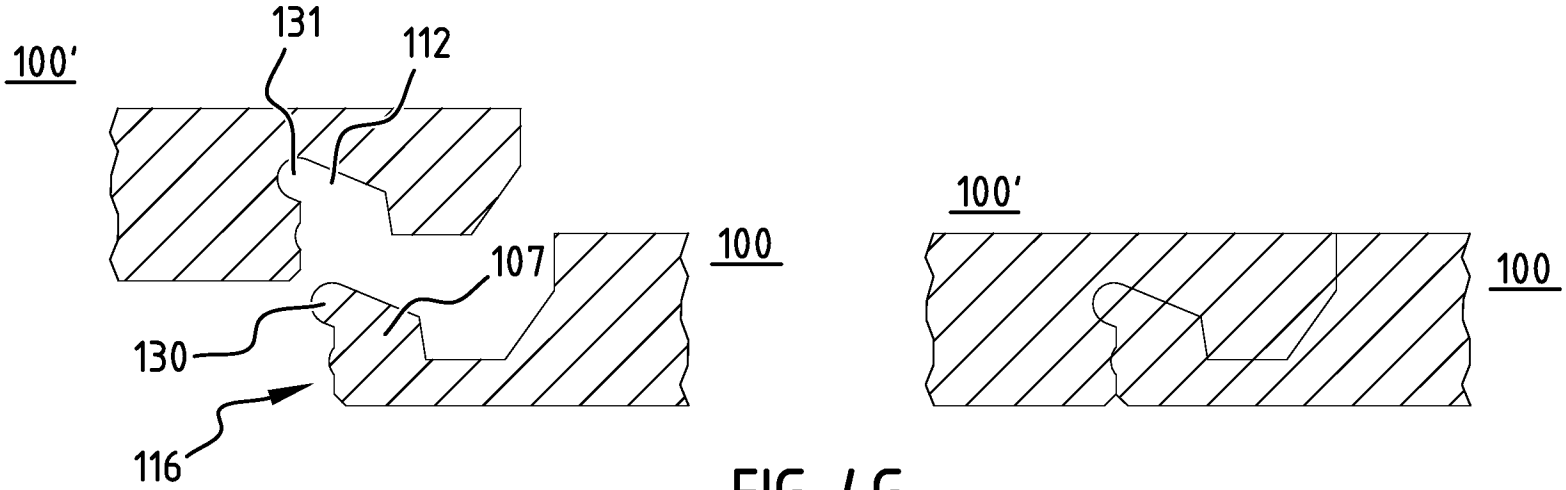

As illustrated in FIG. 4G, a similar bulge 130 can be provided on the other side of upward tongue 107. More in particular, curved portion 113 of upward tongue 107 may bulge outwardly beyond at least a portion of downward flank 116. By providing a suitable cavity 131 in downward groove 112 a further locking against vertical movement between panels 100, 100' can be obtained.

Figure 4H:
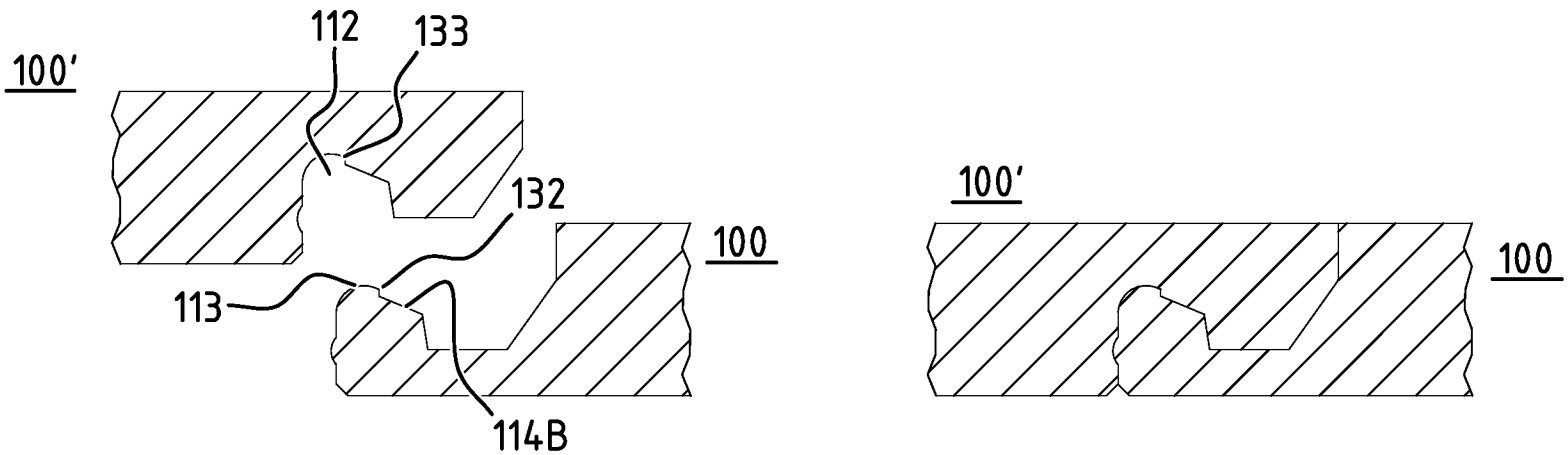

In the embodiment shown in FIG. 4H, a step 132 in a direction parallel to a normal of panel 100 is visible between upward flank 114, and more in particular second flank portion 114B, and curved portion 113. A similar step 133 is visible in downward groove 112. Together, steps 132, 133 provide a further locking against mutual movement of panels 100, 100' in a direction parallel to a top surface of panels 100, 100' and away from each other.

Figure 4I:
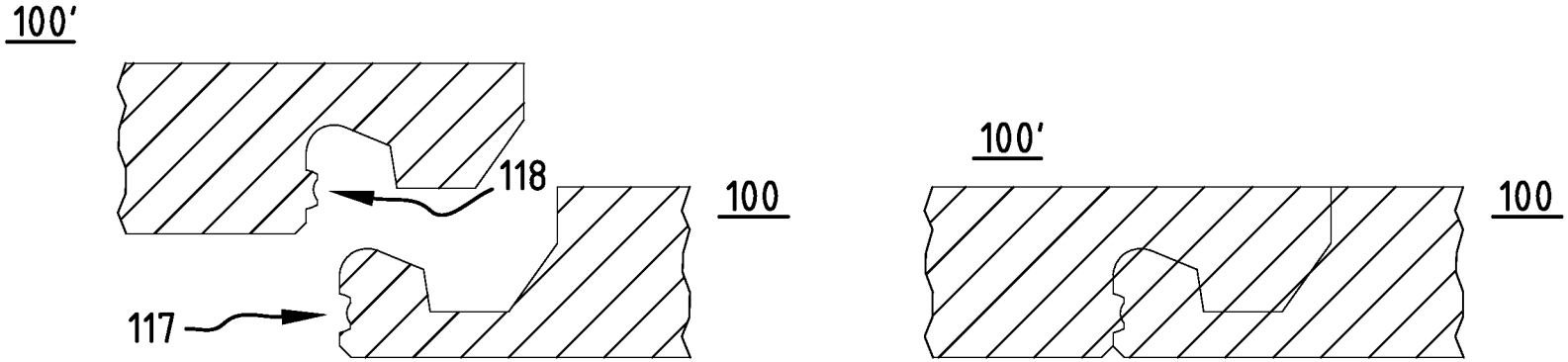

In the FIG. 4I embodiment, a particular configuration for first locking element 117 and second locking element 118 is shown. This configuration is shown in more detail in FIG. 5A. Here, first locking element 117 comprises a recess 200 that extends inwardly relative to downward flank 116. Recess 200 comprises a bottom 201 and side walls 202 extending from bottom 201 to an outside of downward flank 116. First locking element 117 further comprises a protruding portion 203 extending from bottom 201 toward the outside of downward flank 116. As shown, protruding portion 203 is fully arranged in recess 200.

Second locking element 118 comprises a protruding portion 300 comprising side walls 301 that extend outwardly from an outside of second inner flank 111 to a base portion 302, and a recess 303 extending from base portion 302 inwardly relative to second inner flank 111. As shown, recess 303 is fully arranged in protruding portion 300.

Protruding portion 300 is divided, by recess 303, into oppositely arranged protruding sub-portions 300A, 300B. In addition, recess 200 is divided, by protruding portion 203, into oppositely arranged sub-recesses 200A, 200B.

Figure 5A:
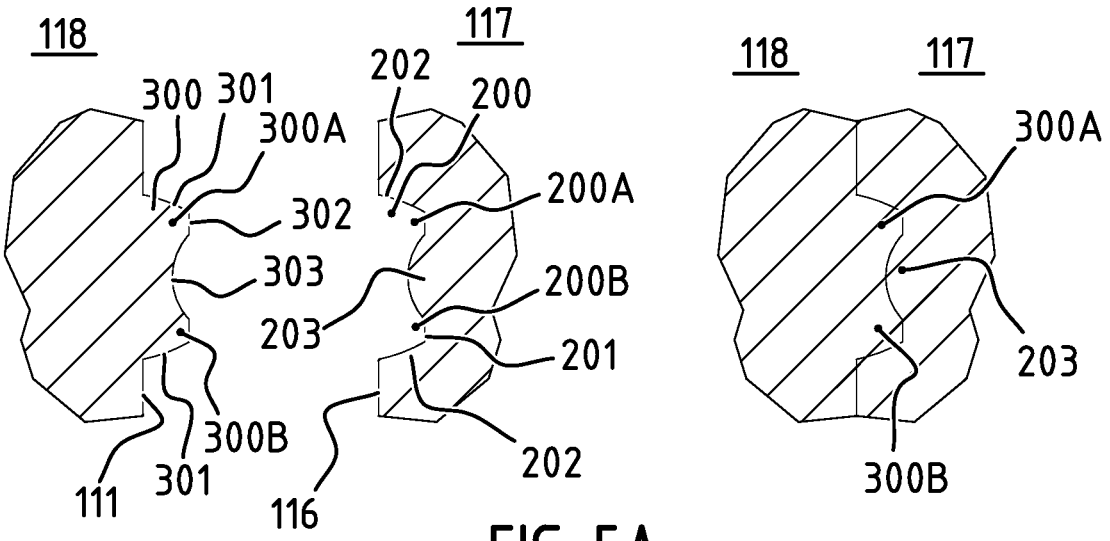
FIGS. 5A and 5B illustrate two different configurations for locking elements in accordance with the present invention.

As shown in the coupled state in FIG. 5A and FIG. 4I, protruding portion 203 is received in recess 303 and each protruding sub-portion 300A. 300B is received in a respective sub-recess 200A, 200B. In this manner, a triple lock function is obtained by first and second locking elements 117, 118.

Figure 5B:
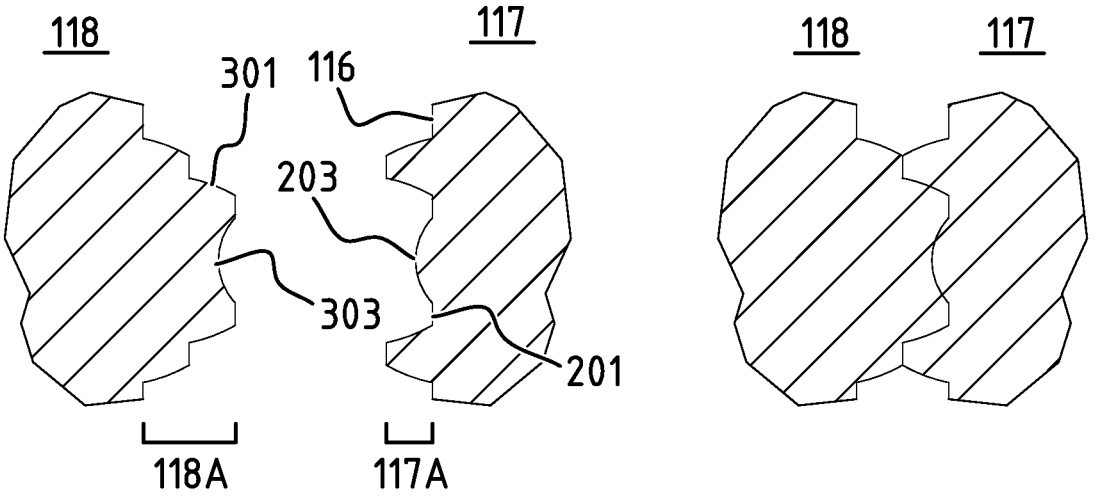

FIG. 5B illustrates a configuration wherein first locking element 117 and second locking element 118 of FIG. 5A are each arranged in or on a respective protruding portion 117A, 118A. As shown, bottom 201 is substantially in line with the remaining part of downward flank 116.

Figure 4J:
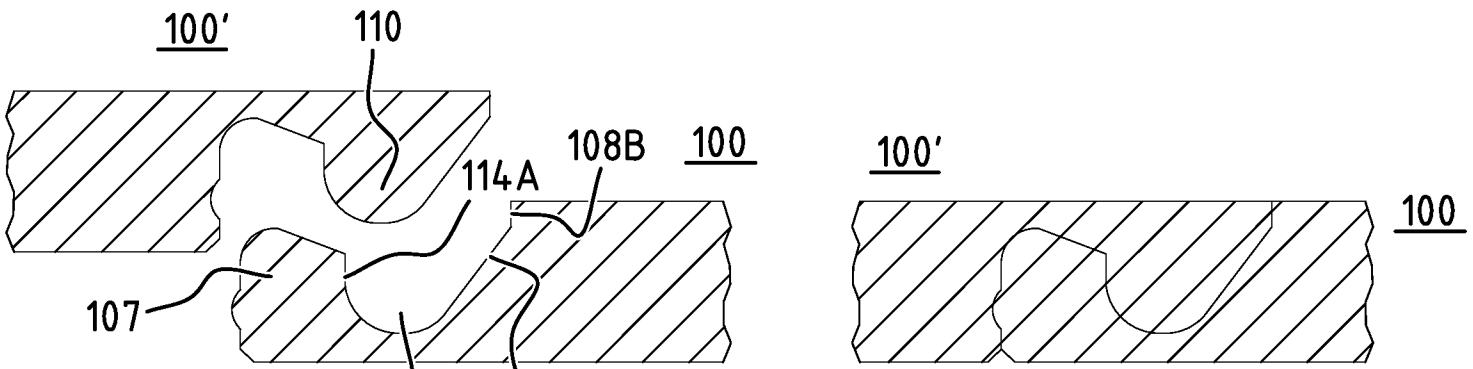
Figure 4K:
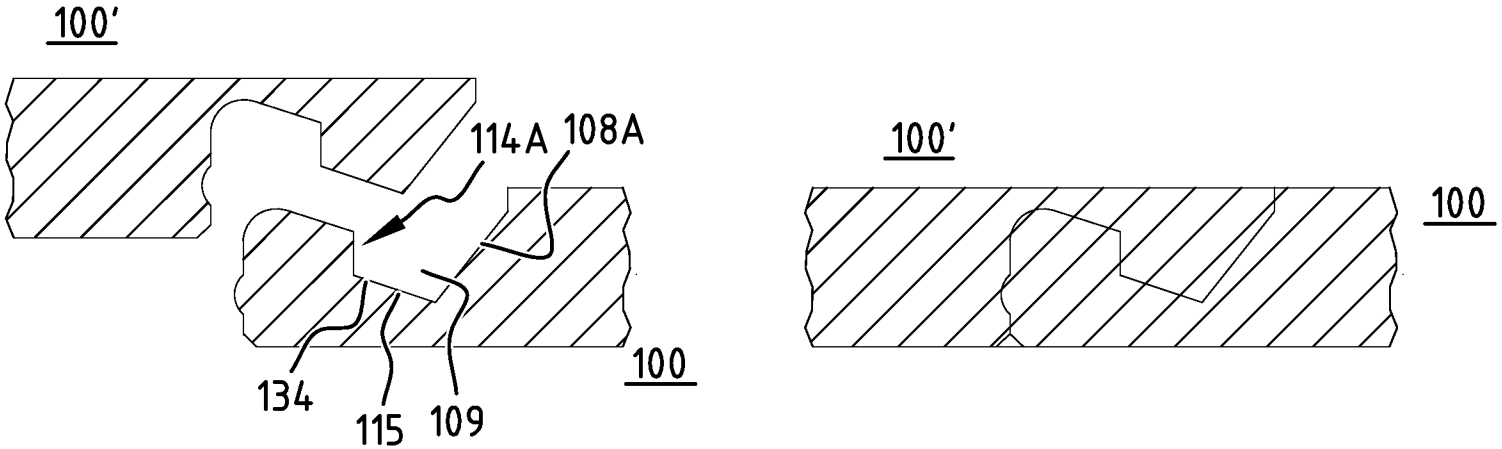

FIGS. 4J and 4K illustrate embodiments with differently shaped upward tongues 107 and upward grooves 109. More in particular, in the embodiment shown in FIG. 4J, first flank portion 114A and first inner flank portion 108A are both curved. Consequently, downward tongue 110 can be embodied using a substantially round shape, allowing a better force distribution over downward tongue 110. However, other configurations are not excluded. For example, in the FIG. 4K embodiment, first flank portion 114A is substantially vertical. Bottom 115 of upward groove 109 comprises an inclined portion 134 connecting inner flank portion 108A and first flank portion 114A.

Figure 4L:
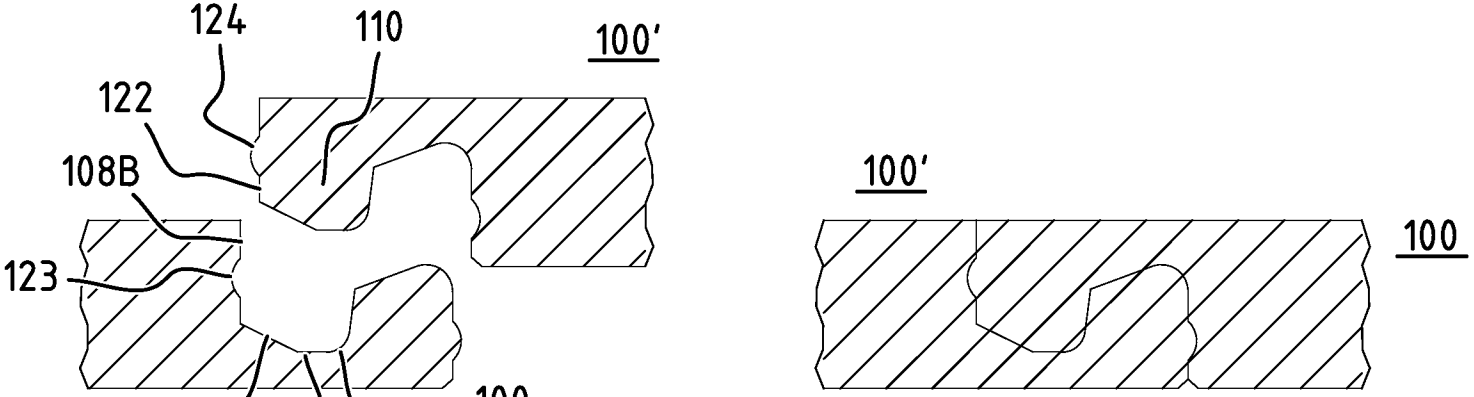

The embodiment shown in FIG. 4L illustrates that the position of the first and second coupling profiles can be reversed. More in particular, the first coupling profile of this embodiment is arranged on the right hand side relative to the cross section shown in FIG. 2B. In this embodiment, first flank portion 114A is curved near starting point S. A flat bottom region 115 can be identified in between first inner flank portion 108A and first flank portion 114A. Moreover, first inner flank portion 108A is inclined relative to a normal of panel 100, whereas first inner flank portion 108B is substantially vertical and is provided with a third locking element 123. A complementarily shaped fourth locking element 124 is provided on upward flank 122 of downward tongue 110.

In the description above, the present invention has been explained using detailed embodiments thereof. However, the present invention is not limited to these embodiments and various modifications to the embodiments shown can be implemented without departing from the scope of the invention which is defined by the appended claims and their equivalents.

LIST OF REFERENCE SIGNS

1, 1' panel
2 core
3 first extension region
4 second extension region
5 first coupling profile
6 second coupling profile
7 upward tongue
8 first inner flank
9 upward groove
10 downward tongue
11 second inner flank
12 downward groove
13 curved portion upward tongue
14 upward flank
15 bottom groove
16 downward flank
16A first part downward flank
16B second part downward flank
17 first coupling element
18 second coupling element
100, 100' panel
102 core
103 first extension region
104 second extension region
105, 105' first coupling profile
106, 106' second coupling profile
107 upward tongue
108 first inner flank
108A first inner flank portion
108B first inner flank portion
109 upward groove
110 downward tongue
111 second inner flank
112 downward groove
113 curved portion upward tongue
114 upward flank
114A first flank portion
114B second flank portion
114C bulge
115 bottom groove
116 downward flank
117 first coupling element
118 second coupling element
119 connection portion
120 downward flank
121 bottom downward groove
122 upward flank
123 third locking element
124 fourth locking element
125 lip
126 first locking surface
127 protruding edge
128 second locking surface
129 edge
130 bulge
131 cavity downward groove
132 step
133 step
134 inclined portion
200 recess
200A, 200B sub-recess
201 bottom
202 side-wall
203 protruding portion
300 protruding portion
300A, 300B protruding sub-portion
301 side-wall
302 base portion
303 recess
U outermost point upward tongue
C connection point
S starting point
O outer point
a1, a2, a3, a4 angles
N normal

The invention claimed is:

1. A panel configured to be used for constructing a floor covering that comprises a plurality of said panels, the panel comprising:

a core having a first side that is provided with a first extension region and a second side that is provided with a second extension region, wherein the first side is oppositely arranged relative to the second side, wherein the first extension region comprises a first coupling profile and wherein the second extension region comprises a second coupling profile that is complementary to the first coupling profile;

wherein the first coupling profile comprises an upward tongue that runs at a distance from and parallel to a first inner flank of the core, wherein a clearance between the first inner flank of the core and the first upward tongue forms an upward groove;

wherein the second coupling profile comprises a downward tongue that runs at a distance from and parallel to a second inner flank of the core, wherein a clearance between the second inner flank of the core and the downward tongue forms a downward groove;

wherein the downward tongue comprises an upward flank forming an outer edge of the panel;

wherein the upward tongue comprises a curved portion, an upward flank extending from a bottom of the upward groove to the curved portion, and a downward flank extending from the curved portion and forming an outer edge of the panel;

wherein the first inner flank is provided with a first locking element;

wherein the upward flank of the downward tongue is provided with a second locking element, wherein the first locking element is configured to co-act with the second locking element of an adjacently arranged further panel for the purpose of mutually locking the panel and the further panel;

wherein an outermost point of the curved portion is positioned further away from the first inner flank than a center point of the upward tongue;

wherein the upward tongue has a width that corresponds to a distance in a direction parallel to the panel between a starting point of the upward flank of the upward tongue and an outer point on the downward flank of the upward tongue, wherein a distance between the starting point of the upward flank of the upward tongue and the outermost point of the curved portion of the upward tongue in a direction parallel to the panel equals x number of times the width of the upward tongue, wherein x is equal to or larger than 0.5, wherein the first locking element is positioned at a vertical distance on the first inner flank from the outermost point of the curved portion, wherein the panel is configured to be coupled with an adjacent panel in a drop-and-lock configuration achieved by a vertical movement of the panel and the adjacent panel relative to one another, and wherein the first inner flank comprises a protruding portion in or on which the first locking element is arranged and wherein the upward flank of the downward tongue comprises a protruding portion in or on which the second locking element is arranged.

2. The panel according to claim 1, wherein the first locking element comprises a recess extending inwardly relative to the first inner flank, wherein the recess has a bottom and side walls extending from the bottom to an outside of the first inner flank.

3. The panel according to claim 2, wherein the first locking element further comprises a protruding portion extending from the bottom of the recess toward the outside of the first inner flank.

4. The panel according to claim 1, wherein the second locking element comprises a protruding portion.

5. The panel according to claim 4, wherein the protruding portion of the second locking element is divided, by a recess of the protruding portion, into two oppositely arranged protruding sub-portions.

6. The panel according to claim 4, wherein the second locking element further comprises a recess extending from the base portion inwardly relative to the upward flank of the downward tongue.

7. The panel according to claim 1, wherein the first locking element comprises a recess extending inwardly relative to the first inner flank, wherein the recess has a bottom and side walls extending from the bottom to an outside of the first inner flank, wherein the first locking element further comprises a protruding portion extending from the bottom of the recess toward the outside of the first inner flank, wherein the second locking element comprises a protruding portion, wherein the protruding portion of the second locking element is divided, by the recess of the second locking element, into two oppositely arranged protruding sub-portions, wherein the second locking element further comprises a recess extending from the base portion inwardly relative to the upward flank of the downward tongue, and wherein the protruding portion of the first locking element is configured to be received in the recess of the second locking element and each protruding sub-portion of the second locking element is configured to be received in a respective sub-recess of the first locking element.

8. The panel according to claim 1, wherein the first extension region extends from the bottom side of the panel and the second extension region extends from the top side of the panel.

9. The panel according to claim 1, wherein the first extension region extends from the top side of the panel and the second extension region extends from the bottom side of the panel.

10. The panel according to claim 1, wherein the downward flank of the upward tongue is provided with a third coupling element, wherein the second inner flank is provided with a second coupling element, and wherein the first coupling element is configured to co-act with the second coupling element of an adjacently arranged further panel for the purpose of mutually locking the panel and further panel.

11. The panel according to claim 1, wherein the upward flank of the upward tongue comprises a curved first flank portion extending from the starting point of the upward flank, and a second flank portion extending between the first flank portion and the curved portion.

12. The panel according to claim 1, wherein x lies in the range between 0.5 and 0.7, wherein the downward flank extends in an outwardly inclined manner relative to the normal of the panel.

13. The panel according to claim 1, wherein the upward flank of the upward tongue comprises a first flank portion extending from the starting point of the upward flank, and a second flank portion extending between the first flank portion and the curved portion, wherein the first flank portion is essentially flat.

14. The panel according to claim 13, wherein the second flank portion is essentially flat.

15. The panel according to claim 13, wherein an angle of the first flank portion relative to a normal of the panel is smaller than an angle of the second flank portion relative to the normal of the panel.

16. The panel according to claim 1, wherein the upward flank of the upward tongue comprises a first flank portion extending from the starting point of the upward flank, and a second flank portion extending between the first flank portion and the curved portion, wherein the first flank portion is curved.

17. The panel according to claim 16, wherein the first inner flank comprises a curved portion connected to the first inner flank, the panel further comprising an outwardly extending lip to which the curved portion of the first inner flank extends, said lip defining a first locking surface that is directed towards the upward groove.

18. The panel according to claim 1, wherein the downward flank extends substantially parallel to a normal of the panel.

19. The panel according to claim 1, wherein the downward flank is, apart from the first locking element, essentially flat.

20. The panel according to claim 1, wherein the first locking element comprises a recess extending inwardly relative to the downward flank, said recess having a bottom and side walls extending from the bottom to an outside of the downward flank, the first locking element further comprising a protruding portion extending from the bottom toward the outside of the downward flank;

wherein the second locking element comprises a protruding portion comprising side walls that extend outwardly from an outside of the second inner flank to a base portion, and a recess extending from the base portion inwardly relative to the second inner flank;

wherein the protruding portion of the second locking element is divided, by the recess of the second locking element, into two oppositely arranged protruding sub-portions;

wherein the recess of the first locking element is divided, by the protruding portion of the first locking element, into two oppositely arranged sub-recesses;

wherein the protruding portion of the first locking element is configured to be received in the recess of the second locking element; and wherein each protruding sub-portion of the second locking element is configured to be received in a respective sub-recess of the first locking element.

21. The panel according to claim 1, wherein the upward flank of the downward tongue comprises a protruding edge that defines a second locking surface; and wherein the first locking surface and the second locking surface are configured to lock an upward movement of an adjacent panel when the second coupling profile of an adjacent panel is coupled to the first coupling profile of the panel and the first and second locking surfaces abut each other.

22. A floor covering comprising a plurality of panels as defined in claim 1, wherein the first coupling profile of a given panel among the plurality of panels is coupled to the second coupling profile of another panel among the plurality of panels that is arranged adjacent to said given panel.

* * * * *